US005704647A

United States Patent [19]

Desbiens

[11] Patent Number: 5,704,647

[45] Date of Patent: Jan. 6, 1998

[54] MULTI-COLOR OVERPRINTING OF SCRATCH-OFF LOTTERY TICKETS

[75] Inventor: Jean-Pierre Desbiens, Fabreville, Canada

[73] Assignee: BABN Technolgies Corporation, Montreal, Canada

[21] Appl. No.: 596,470

[22] Filed: Feb. 5, 1996

[30] Foreign Application Priority Data

Jun. 7, 1995 [GB] United Kingdom ..... 95 11 499

[51] Int. Cl.[6] ..... B42D 15/00

[52] U.S. Cl. ..... 283/67; 285/903

[58] Field of Search ..... 283/81, 903, 94, 283/95, 98, 100, 114, 67; 273/161

[56] References Cited

U.S. PATENT DOCUMENTS

| | | | |
|---|---|---|---|
| 4,643,454 | 2/1987 | Ondis | 283/903 X |
| 4,726,608 | 2/1988 | Walton | 283/903 X |
| 5,074,566 | 12/1991 | Dasbiens | 283/903 X |
| 5,193,854 | 3/1993 | Borowski, Jr. et al. | 283/903 X |

*Primary Examiner*—Willmon Fridie, Jr.

*Attorney, Agent, or Firm*—Watov & Kipnes, P.C.

[57] ABSTRACT

A method of producing a lottery ticket and lottery tickets produced thereby wherein an overprinting layer is provided over a scratch-off layer, the overprinting layer comprising an image obtained from a design in which the colors in the design have been separated into half tone images of each color and are superimposed on the scratch-off layer of the lottery ticket.

4 Claims, 3 Drawing Sheets

MULTI-COLOR OVERPRINTING OF SCRATCH-OFF LOTTERY TICKETS

FIELD OF THE INVENTION

The present invention is directed generally to a method of producing lottery tickets and especially lottery tickets with a scratch-off layer which has been overprinted with a multi-color overprinting technique to improve security of the lottery ticket. Lottery tickets prepared by the method are also the subject of the present invention.

BACKGROUND OF THE INVENTION

Scratch-off type lottery tickets are well known products of the lottery industry. Such tickets comprise a substrate having at least one area overprinted with an elastomer such as an opaque latex ink. When the latex ink dries, it forms a protective coating that can be scratched off to reveal printed indicia indicating whether or not a prize has been won.

In the late 1980's the use of foil laminated substrates was criticized on environmental grounds. The foil is not biodegradable and can not be readily recycled. Accordingly, lottery sponsors have encouraged lottery ticket manufacturers to create an environmentally compatible lottery ticket which can be authenticated with the same degree of assurance as foil laminated tickets. Virgin and preferably recycled paper are preferred substrates for environmentally compatible lottery tickets.

Authentication of a non-foil paper substrate was complicated by the development of high quality color photocopiers which occurred in the late 1980's. Such copiers are capable of duplicating a winning ticket with a high degree of precision even for multicolored lottery tickets. In addition, authentication of valid winning tickets is primarily the responsibility of the lottery ticket retailer. He or she is charged with the responsibility of visually checking the ticket to detect any signs of tampering or duplication. However, retail agents often do not have the time to carefully check winning tickets, particularly during peak sale periods. Furthermore, any equipment which may be required for authentication, such as ultraviolet light is either too time consuming or bulky for convenient use by retail agents.

There have been a variety of efforts proposed to prevent tampering of lottery tickets as disclosed for example in Joseph C. Borowski, Jr. et al., U.S. Pat. No. 5,403,039 and references cited therein, each of which is incorporated herein by reference. Included among these anti-counterfeiting methods are the use of inks and blush coatings which undergo a reversible color change, the use of pattern layers to render visually hidden indicia on the ticket indistinguishable to a photocopy machine, the use of overlapping but non-registerable imprints, and the use of thermographic layers which change color upon the application of heat. While all of these methods improve the integrity of lottery tickets by making them more difficult to counterfeit, they each require one or more additional layers of material or process steps which adds to the cost of producing the lottery ticket.

It is also known in the art to print a simple design over the latex-based scratch-off area. The purpose of this overprinting technique is a) to improve security of the lottery ticket and b) to enhance the overall appearance of the lottery ticket. Typical printing processes include the application of up to four flat separate colors in various graphic line designs and/or text.

With regard to security, prior art overprinting techniques have only been minimally successful. Counterfeiting techniques such as pin-holing and chemical attack have been used successfully against such overprinted lottery tickets. In addition, it is possible to remove the overprint layer in its entirety and then reprint the same design with ready available and generally inexpensive printing equipment. This is because the overprint processes currently employed create only basic color patterns which are easily duplicated.

Present overprinting techniques therefore are not an effective deterrent to counterfeiting. Accordingly, lottery manufacturers may still have to employ additional anticounterfeiting measures as discussed above to provide a secure lottery ticket. These additional measures are disadvantageous because they add to the cost of manufacturing the lottery tickets.

It would therefore be a significant advance in the art of preparing scratch-off lottery tickets to provide an overprinting technique which provides greater resistance to counterfeiting than previous overprinting techniques. It would also be desirable to employ an overprinting technique which enhances the overall appearance of the lottery ticket.

SUMMARY OF THE INVENTION

The present invention is generally directed to a scratch-off type lottery ticket in which an overprint layer is applied over a scratch-off layer to provide a lottery ticket which is resistant to counterfeiting and has an exceptional appearance.

In particular, the present invention is directed to a method of producing a lottery ticket having a scratch-off layer comprising:

a) providing printed indicia on a substrate;

b) covering at least a portion of the printed indicia with a scratch-off layer; and c) providing an overprinting layer over the scratch-off layer, said overprinting layer comprising a full color image obtained from a design in which individual colors in the design have been separated into screened half tone images of said individual colors and said screened half tone images are printed one over the other.

Lottery tickets having said full color images printed over a scratch-off layer are encompassed by the present invention as well.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The scratch-off lottery tickets of the present invention include an overprint layer printed over a scratch-off layer.

The removal of the scratch-off layer reveals information necessary for the disposition of the lottery ticket such as whether or not a prize has been won. In accordance with the present invention the overprint layer is comprised of the combination of colors so as to produce a complex image (e.g. a reproduction of a painting such as the "Mona Lisa") that is extremely difficult to reproduce, especially with inexpensive printing equipment. The overprint layer therefore provides a level of security to a scratch-off lottery ticket which is superior to prior overprinted lottery tickets. In addition, the appearance of the lottery ticket is significantly improved.

Figure 1:
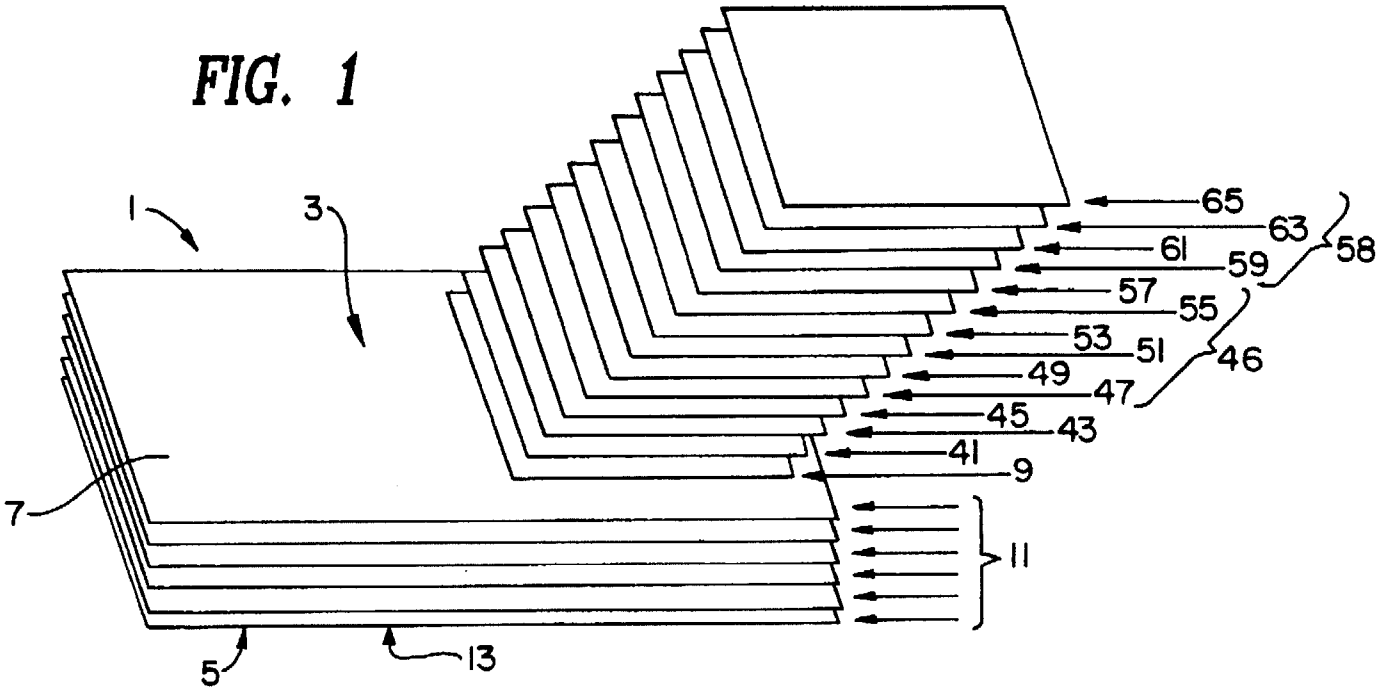
FIG. 1 is a schematic exploded view of an embodiment of a scratch-off instant lottery ticket in accordance with the prior art.

There is shown in FIG. 1 an embodiment of a scratch-off lottery ticket in accordance with the present invention. Referring to FIG. 1 a scratch-off lottery ticket 1 includes a substrate 11 which may be comprised of one or more layers with several layers being shown, having a front surface 3, and a back surface 5. The front surface 3 is typically provided with a graphic area 7 and a game area 9.

The substrate 11 may be any material suitable for making a scratch-off lottery ticket such as foil laminate. However, since the foil is not biodegradable or recyclable, it is preferred to use Virgin or recycled paper as the substrate. The back surface 5 of the substrate may be provided with printed indicia as represented by reference numeral 13 such as instructions for claiming a prize or optional validation information such as a barcode. As used herein the term printed indicia shall mean words, symbols, designs whether black or white or in color, pictures and the like which convey information about the lottery ticket including, but not limited to, whether or not a prize has been won.

In the embodiment shown in FIG. 1, overlying the game area 9 is the placement of printed indicia 41 such as game symbols and prize amounts. The printed indicia 41 is covered by at least one layer of clear or colored varnishes. As shown in FIG. 1, and for illustrative purposes only, two layers 43, 45 of varnishes are applied over the printed indicia 41 to protect the same and to allow for easier removal of the scratch-off layer as described hereinafter.

A scratch-off layer 46, typically made up of multiple layers of scratch-off material is then applied over the varnish layers. As shown specifically in FIG. 1, and by way of example only, the scratch-off layer 46 comprises a layer of black elastomer 47, a layer of medium gray elastomer 49 and four layers of white elastomer 51, 53, 55 and 57 respectively. The use of a white elastomer as the top layers of the scratch-off layer 46 is preferred so as to provide an acceptable surface upon which the desired printed indicia, such as a photograph can be applied.

The desired indicia is represented in FIG. 1 by an overprint layer 58. This layer comprises an image obtained from a design in which the colors in the design have been separated into half tone images of each color which are used to provide the overprinting layer. The colors are then printed on to the lottery ticket one over the other. In the embodiment shown in FIG. 1, the overprinting layer 58 is comprised of four overprint layers 59, 61, 63 and 65 which correspond to four different process colors such as yellow, magenta, cyan, and black.

It will be understood that the lottery ticket of the present invention can contain additional layers as is customary in the production of scratch-off lottery tickets. For example, a release coating (not shown) may be provided over the varnish layers 43, 45 to provide a smooth surface for printing of the scratch-off layer.

Figure 2:
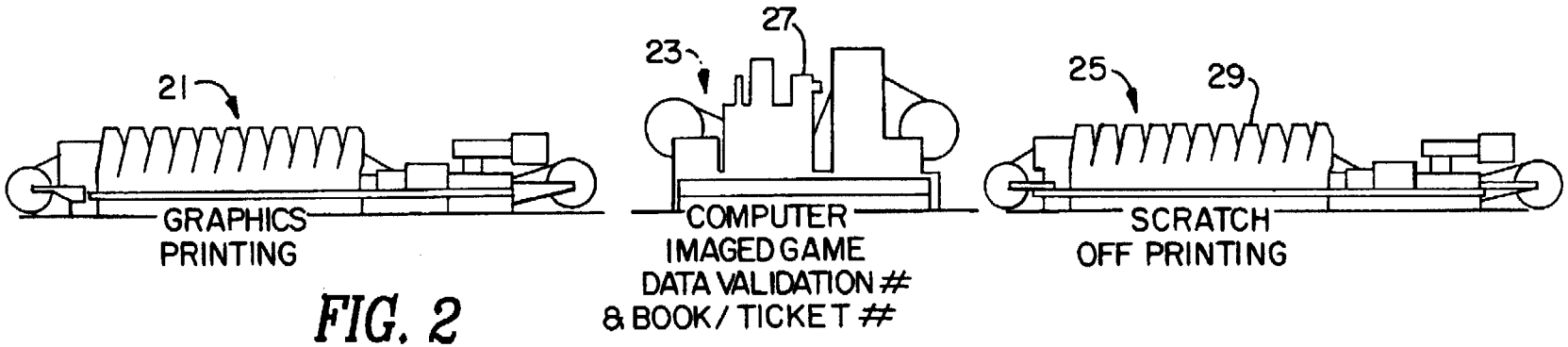
FIG. 2 is a schematic view of an overprinting process employed in accordance with the present invention.
Figure 3:
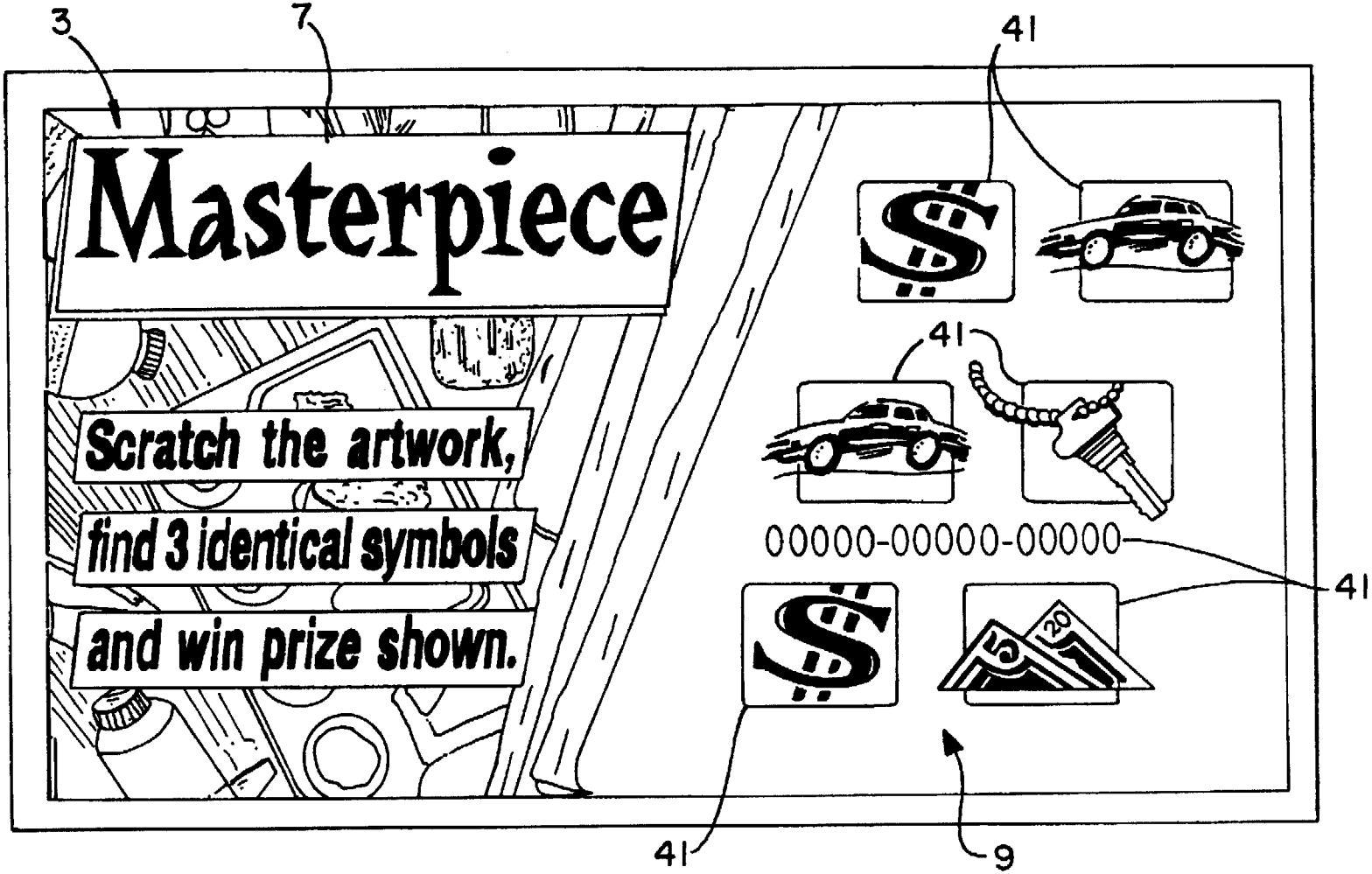
FIG. 3 is a top plan view of a scratch-off lottery ticket having a scratch-off area, before the application of the overprint layer.

The lottery tickets of the present invention can be produced by way of example, in the following manner. Referring to FIG. 2, there is shown a three station printing operation in which in a first station 21 printed indicia is printed on the graphic area 7 of the lottery ticket. Such printed indicia for this region of the lottery ticket includes, but is not limited to, the name of the lottery game, illustrations, textual material, issue numbers, background colors and the like. The back surface 5 can also be printed with printed indicia such as instructions for claiming a prize, and the like. The printing is carried out using known technologies such as flexography, gravure printing, screen printing, lithography, dry offset printing and the like.

The second stage of operation noted by numeral 23 is concerned with printing printed indicia 41 on the game area 9 of the lottery ticket shown in FIG. 1. The printed indicia 41 appearing in the game area 9 includes game symbols, numbering and prize amounts, and the like. This stage of operation is typically carried out with tapes containing the printed indicia which are used to drive an inkjet imager 27 to print the printed indicia 41 on the game area 9.

The next step of the operation indicated by numeral 25 concerns covering the game area 9 so that the printed indicia 41 is hidden from view. In this stage of operation, one or more layers of varnish 43, 45, an optional release coating layer (not shown), the scratch-off layer 46 and the overprint layer 58 are then applied. This operation is preferably accomplished with a 12-station web flexographic press indicated by numeral 29 equipped with in-setting capacity so that the press can precisely register the ticket and keep it aligned to ensure that the printed indicia 41 is completely covered by the scratch-off layer and the overprint layer.

In operation of the 12-station web flexographic press 29, the first and second stations can be used to apply the clear or colored varnishes 43, 45 either to the front surface 3 or to the game area 9 only. As previously indicated, the varnish layers protect the printed indicia 41 and are resistant to some forms of chemical counterfeiting such as through the use of bleaching agents. The varnish layers 43, 45 also facilitate the removal of the scratch-off layer by the user.

A third station of the flexographic press may be used to apply to release coating as previously described. In this case, one of the following layers may be omitted, such as one of the white elastomer layers, so that the entire printing process can take place within the 12-station operation of the press 29.

In the absence of an optional release coating layer, the third station of the press is used to apply a layer of black elastomer (e.g. latex ink coating) 47 and the fourth station is used to apply a layer of medium gray elastomer 49 in order to remove the game area 9 from view. The fifth through the eighth stations of the press are used to print the four layers of white elastomer 51, 53, 55 and 57. As previously indicated, the purpose of the white elastomer layer is to provide an appropriate surface by which the overprint layer 58 can be readily applied.

In a four-color process system for printing the overprint layer 58, a full-color design, a photograph, a painting or other complex image is reproduced and applied to the lottery ticket. This is accomplished by separating the spectrum of colors from the original into a screened half tone image of each of the colors used in the four-color process blending technique. The separated images are then printed one over the other in transparent ink. When the separated images are superimposed, they combine and blend optically to produce the visual effect of full color with virtually limitless tones and shades.

The four colors used in a typical four color process are yellow, magenta, cyan and black. The order of printing of the colors can vary but the preferred order of printing is yellow, magenta, cyan and black. Thus, employing a 12-station web flexographic press 29 as shown in FIG. 2, the ninth station prints the yellow plate 59 on the white surface provided by the scratch-off layer 46. The tenth station overprints the magenta plate 61 while the eleventh station overprints the cyan plate 63. Finally, the twelfth station overprints the black plate 65 so that the four colors combine and blend optically to reproduce the desired image.

Figure 4:
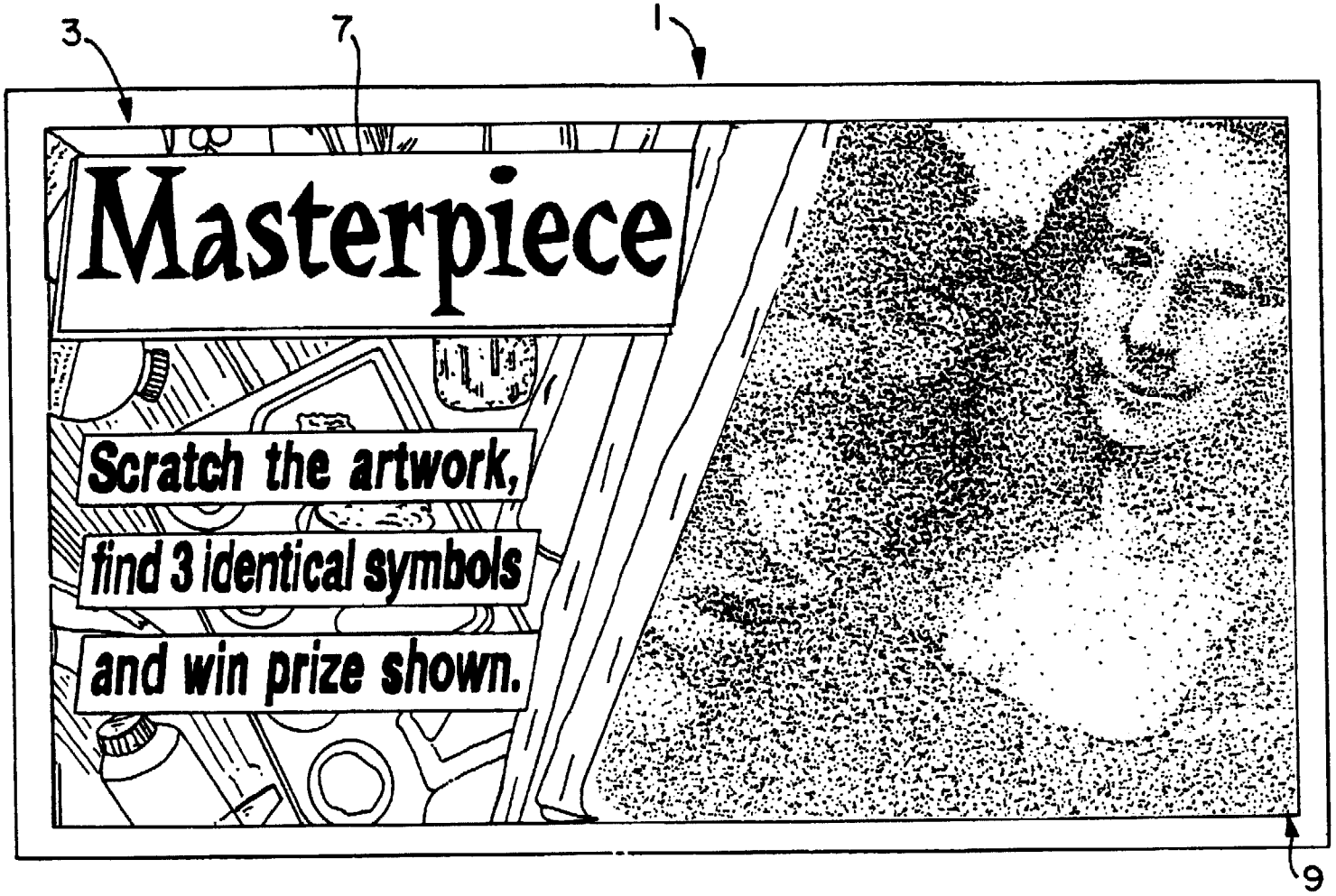
FIG. 4 is a top plan view similar to FIG. 3 with the overprint layer applied to the scratch-off area in accordance with the present invention.

An example of an image that can be reproduced with visual clarity is shown in FIG. 4. It will be noted that the overprinted images provide tremendous detail so that counterfeiting is rendered difficult if not impossible. In particular, it is very difficult to reproduce a four-color overprint using, for example, a small screen press or any other readily available inexpensive printing equipment which is typically employed by counterfeiters. In addition, retouching of the surface of the lottery ticket is made practically impossible because of the complexity of the image overlaying the printed indicia. Retouching is a common technique when counterfeiters scratch very small portions of the scratch-off layer with a pin or other fine pointed instrument to reveal tiny portions of the printed indicia.

In carrying out the process of the present invention, in order to ensure proper alignment of each of the printing layers comprising the overprinting layer 58, photocell devices installed in each of the twelve stations of the press 29 may be linked to various controls of the paper feeding mechanism of the press 29. Preferably, the registration devices in the flexographic press 29 should allow for no more than a 0.005 inch variation on each station.

What is claimed:

1. A method of producing a lottery ticket comprising:

(a) applying printed indicia on a substrate;

(b) covering at least a portion of the printed indicia with a scratch-off layer; and (c) applying an overprinting layer over the scratch-off layer, said overprinting layer comprising an image obtained from a design in which at least two colors in the design have been separated into screened half tone images of each color and then said images are superimposed in separate printing steps to form said overprinting layer.

2. The method of claim 1 comprising separating four colors from the design.

3. The method of claim 2 wherein the colors are yellow, magenta, cyan and black.

4. A lottery ticket produced by the process of claim 1.

* * * * *

UNITED STATES PATENT AND TRADEMARK OFFICE

CERTIFICATE OF CORRECTION

PATENT NO. : 5,704,647
DATED : January 6, 1998
INVENTOR(S) : Jean-Pierres Desbiens It is certified that error appears in the above-identified patent and that said Letters Patent is hereby corrected as shown below:

Title page,
Insert Item -- [63] Related U.S. Application Data:
Continuation-in-part of Application Ser. No. 08/528,055, September 14, 1995, abandoned. --.

Column 1,
Line 3, insert the following statement:
-- This application is a continuation-in-part of Application Serial No. 08/528,055, filed on September 14, 1995, now abandoned. --.

Signed and Sealed this

Twenty-second Day of November, 2005

JON W. DUDAS
*Director of the United States Patent and Trademark Office*